US007704057B2

(12) United States Patent
Malbec et al.

(10) Patent No.: US 7,704,057 B2
(45) Date of Patent: Apr. 27, 2010

(54) PERISTALTIC PUMP WITH A REMOVABLE AND DEFORMABLE CARRIER

(75) Inventors: Bertrand Malbec, Le Gond Pontouvre (FR); Jean-Marie Perrot, Angoulême (FR)

(73) Assignee: Athena Innovations, Paris (FR)

( * ) Notice: Subject to any disclaimer, the term of this patent is extended or adjusted under 35 U.S.C. 154(b) by 592 days.

(21) Appl. No.: 10/570,149

(22) PCT Filed: Sep. 7, 2004

(86) PCT No.: PCT/FR2004/002264

§ 371 (c)(1),
(2), (4) Date: Jul. 3, 2006

(87) PCT Pub. No.: WO2005/026550

PCT Pub. Date: Mar. 24, 2005

(65) Prior Publication Data

US 2007/0020130 A1 Jan. 25, 2007

(30) Foreign Application Priority Data

Sep. 8, 2003 (FR) ..... 03 10557

(51) Int. Cl.
*F04B 45/08* (2006.01)
*F04B 43/08* (2006.01)

(52) U.S. Cl. ..... 417/477.1; 417/474; 417/476

(58) Field of Classification Search ..... 417/474, 417/476, 477.1, 477.9, 477.11, 477.12
See application file for complete search history.

(56) References Cited

U.S. PATENT DOCUMENTS

| | | | | |
|---|---|---|---|---|
| 3,249,059 | A | 5/1966 | Renn | |
| 4,746,279 | A * | 5/1988 | Manella | 417/474 |
| 5,249,937 | A * | 10/1993 | Aubert | 417/475 |
| 5,549,461 | A * | 8/1996 | Newland | 417/477.11 |
| 5,759,017 | A * | 6/1998 | Patton et al. | 417/477.9 |
| 7,287,968 | B2 * | 10/2007 | Haser et al. | 417/477.9 |

FOREIGN PATENT DOCUMENTS

| | | |
|---|---|---|
| DE | 100 62 600 | 6/2002 |
| SU | 1 262 106 | 10/1986 |

* cited by examiner

*Primary Examiner*—Devon C Kramer
*Assistant Examiner*—Patrick Hamo
(74) *Attorney, Agent, or Firm*—Young & Thompson

(57) ABSTRACT

A peristaltic pump includes a removable carrier against which a flexible tube is pressed by rollers. The carrier includes an intermediate deformable section having an internal cylindrical surface whose axis coincides with the main axis of rotation of the rollers and lateral rigid arms arranged on both sides of the intermediate section. The free ends of the lateral arms include guides. The pump case is provided with paths on which the guides are slidable. The path directions are predefined in order to constrain the displacement of the free ends of the lateral arms and to deform the intermediate section in such a way that the radius of the internal face is modified keeping the axis thereof coinciding with the main axis, thereby making it possible to use a tube having variable characteristics.

18 Claims, 7 Drawing Sheets

PERISTALTIC PUMP WITH A REMOVABLE AND DEFORMABLE CARRIER

BACKGROUND OF THE INVENTION

1. Field of the Invention

The present invention relates to peristaltic pumps with deformable tubing.

2. Description of the Related Art

In general, peristaltic pumps are composed of a frame to which is fastened a motor whose shaft rotates a cage comprising a plurality of rollers. The rollers are in contact with a deformable tubing that they compress until it is sealed. The angular displacement of the point of sealing causes, behind the compressed zone, a vacuum in the tubing that immediately fills with fluid. The amount of fluid trapped in the deformable tubing between two rollers is then propelled to the outlet of the pump. A liquid, pumped at an open end of the deformable tubing, called the intake or upstream end, is thus conveyed to the other end of the deformable tubing, called the delivery or downstream end. Most peristaltic pumps comprise a casing having a cylindrical inner surface, called the bearing surface, against which the tubing is compressed by the rollers to seal it. The envelope swept by the paths of the outer surfaces of the rollers is called the runway or rolling path.

The main component of a peristaltic pump is its pump body tubing, which is generally made of elastomer. The pump body tubing is made by extrusion. The physical and dimensional properties of the tubing given by the manufacturer are only average values. The measured values of a particular property fluctuate statistically, for example according to Gauss' Law, about the corresponding average value. The deformable tubing manufacturer defines a tolerance interval around the average value in which there is an increased probability of finding the measured value of the property. The measured thickness of a deformable tubing at the point where it is deformed fluctuates about the average value. It is therefore probable that the portion of deformable tubing compressed by the rollers has walls whose combined thickness is less than or greater than the nominal sealing dimension provided for by the pump manufacturer. Incidentally, the sealing of the pump body tubing, characterized by the sealing dimension, consists in first placing the two walls of the tubing in contact and then applying an appropriate clamping action depending on the thickness of the tubing, its hardness, the temperature, etc.

Similarly, during the use of the deformable tubing, the wall suffers from wear, swelling, loss of thickness, modification of the physical nature of the material of which the tubing is made, etc. This wear in the broad sense may be due to the repeated mechanical action of the rollers on the outer surface of the tubing, to the chemical action of the liquids conveyed within the tubing on the inner surface of the tubing, or to the conditions under which the peristaltic pump is used, for example temperature. Consequently, the combined thickness of the walls of the deformable tubing tends to vary over time. The time comes when the cumulative thickness of the walls becomes less than or greater than the nominal sealing dimension.

When the nominal sealing dimension is not complied with, either the peristaltic pump becomes less efficient because the seal is not achieved, or the excessive thickness leads to excessive clamping, increasing the resistive torque of the peristaltic pump.

For a given type of tubing, there is therefore a need for a peristaltic pump that can compensate for variations in the properties of the tubing.

Moreover, it must be possible for a user to be able to replace a first tubing by a second pump body tubing rapidly. The adjustments required in order for the peristaltic pump to be able to operate with a second tubing must be easy to carry out, and preferably automatic, minimizing risks of error.

Moreover, in the medical field in particular, the deformable tubing must be completely changed for each new application, in particular for reasons of hygiene. There is a permanent need to simplify the consumable so as to increase the number of parts that can be reused from one application to the next, to reduce the operating cost of the pump and the number of components, often made of plastic, that are thrown away on each new application.

To solve these various problems, the manufacturers of peristaltic pumps have to find mechanical solutions that will guarantee sealing. The best known solutions consist in mechanically varying the radial distance between the inner surface of the bearing surface and the rolling paths of the rollers on the pump body tubing.

Patent SU 1 262 106 of 7 Oct. 1986 discloses an improved peristaltic pump for limiting fluctuations in flow rate during use. The flexible tubing is in this case compressed between a plurality of rollers and a flexible U-shaped strip. The curve of the flexible strip is set by tangential adjustment pins connected to the ends of the flexible strip and radial adjustment pins connected to a central portion of the flexible strip. By turning the adjustment pins to a greater or lesser extent, the user gives the flexible strip an optimum shape.

The deformable tubing is compressed until it is sealed only against the central portion of the flexible strip whose profile is an arc of a circle with an opening of $360°/\kappa$ and a radius $r_1=r_0+2e$ (where $\kappa$ is the number of rollers and $r_0$ is the radius of the rolling path run by the rollers). The profile of the input and output sections is curved and follows the equation $r_2=r_1+D\ 2r$ (where r is the internal radius of the tubing and D a parameter corresponding to the degree of compression of the tubing varying between 0 and 1).

That document does not describe how the deformable tubing is inserted between the flexible strip and the rollers. Although in the above equations the thickness and the radius of the deformable tubing are in the form of parameters, the use of deformable tubing having variable properties is not discussed. No particular information about the variation of the parameter D along the input and output sections is given in order to define the optimum profile. Lastly, the curve of the flexible strip is adjusted manually by the user during operation of the pump.

Patent SU 794 243 of 7 Jan. 1981 describes a peristaltic pump whose tubing support is wound to form a helical turn around a roller mounted on a shaft that is off-centre with respect to the axis of the helix. The deformable tubing is placed between the roller and the tubing support. The tubing support consists of a metal strip having a degree of elasticity whose tubing ends are joined by an adjustment screw. When the user turns the screw, the two ends of the strip move towards or away from one another. As a result, the radius of the helix is modified to change the distance between the tubing support and the roller to modify the occlusion of the deformable tubing making it possible to compensate for the thickness of the tubing.

Moreover, the tubing support is connected to the frame by a series of bolts that are distributed regularly in an annular arrangement, each engaged in a guide groove. The guide grooves, whose shape is not described, make it possible indirectly to limit the displacement of the tubing support so that it has a constant radius of curvature all along its length. Once the user has made the adjustment, the bolts are tightened, which prevents any modification of the radius during operation of the pump.

Lastly, U.S. Pat. No. 5,549,461, granted on 27 Aug. 1996, discloses a peristaltic pump comprising an occluder ring linked to a hinged support by means of a series of threaded bolts. While the rollers are turning, the hinged support is lowered so that the deformable tubing is compressed against the occluder ring, thus functioning as a clutch for the pump. In the lowered position, the hinged support is kept against the frame by a closure system that prevents excessive pressure if necessary. The radius of the occluder ring, which is concentric with the axis of rotation of the rollers, can be adjusted by the user by means of a series of screws to allow the pump to be used with deformable tubing of different thicknesses.

The peristaltic pump described is not made for delicate laboratory or medical applications. The curvature of the ring and the means of obtaining it by screwing the bolts are not described.

SUMMARY OF THE INVENTION

The aim of the invention is to provide another technical solution to the problems set out above and to overcome the abovementioned drawbacks.

The subject of the invention is therefore a peristaltic pump, designed to operate with a deformable flexible pump body tubing, comprising a shell, a bearing surface forming a casing with the shell, and a plurality of cylindrical rollers housed inside the casing, the rollers being rotatable about a main axis and able to compress the tubing at least one point on a surface of the bearing surface, facing the inside of the casing, known as the inner surface, characterized in that the bearing surface comprises an intermediate deformable portion with an intermediate inner surface having the shape of a cylinder whose axis coincides with the main axis, and first and second rigid side arms on either side of the deformable intermediate portion, first and second free ends of the first and second rigid side arms comprising, respectively, first and second guide means, and in that the shell comprises upstream and downstream tracks on which the first and second guide means can slide, the upstream and downstream tracks having respective predefined paths for limiting the displacement of the first and second free ends of the first and second rigid side arms so as to deform the deformable intermediate portion so that the radius of the intermediate inner surface is modified while leaving the axis of the intermediate inner surface in coincidence with the main axis, so that the peristaltic pump adapts automatically to a tubing having variable physical and geometric properties.

Preferably, the bearing surface is removable to allow a pump body tubing to be positioned between at least one roller of the plurality of rollers and the intermediate inner surface of the deformable intermediate section of the bearing surface.

Also preferably, the bearing surface is placed on the shell of the peristaltic pump during the starting up of the peristaltic pump.

Preferably, the bearing surface is placed on the shell by snapping the first and second guide means onto the upstream and downstream tracks.

Preferably, the shell consists of the combination of an inner component and an outer component, the bearing surface being joined to the outer component so as to optionally form an interchangeable subassembly with a pump body tubing, the interchangeable subassembly being placed on the inner component of the shell during the starting up of the peristaltic pump.

Preferably, the peristaltic pump is symmetrical about a main plane of symmetry defined by the main axis and the bisector of the angle of opening of the intermediate inner surface.

Preferably, the variation in the radius of the intermediate inner surface with respect to the radius at rest of the intermediate inner surface is no more than 10%.

Preferably, the plurality of rollers consists of three rollers and the intermediate inner surface has an angle of opening of at least 120° so that, at any time, at least one of the three rollers is opposite the intermediate inner surface, the tubing being compressed at least one point.

Also preferably, the length of the first and second side arms is between 0.9 and 1.2 times the value of the radius at rest (R) of the intermediate inner surface.

Preferably, the predefined path of the upstream and downstream tracks is comparable to first and second line segments lying in a plane perpendicular to the main axis, the segments each making an angle of about 45° with the main plane.

In another embodiment, the predefined path of the upstream and downstream tracks is comparable to arcs of a circle, the centre of which lies in a plane perpendicular to the main axis.

Preferably the first and second guide means consist of first and second bosses situated laterally on the respective free ends of each of the first and second side arms, and able to slide respectively along the upstream and downstream tracks.

Preferably, the upstream and downstream tracks consist of chamfered lateral surfaces of first and second main walls of the shell.

In another embodiment, the upstream and downstream tracks consist of lateral surfaces of recesses made in the first and second main walls of the shell.

In a variant, the upstream and downstream tracks are notched.

Preferably, the bearing surface comprises secondary guide means located at the apex of the deformable intermediate portion and projecting laterally on either side of the latter, and the shell comprises first and second grooves made, in the main plane of symmetry, in first and second main walls of the shell, the grooves being designed to cooperate with the secondary guide means to keep the bearing surface symmetrical about the main plane of symmetry during operation of the peristaltic pump.

Preferably, the pump comprises storage means which enable the bearing surface to be held in place on the shell so that the pump body tubing is not stressed during storage of the pump, the storage means allowing the bearing surface to be correctly positioned during use of the pump.

Preferably, the shell comprises upstream and downstream fixed counter-bearing surfaces that are placed respectively facing first and second inner surfaces of the first and second side arms to keep the tubing stationary with respect to the bearing surface during use of the peristaltic pump.

Preferably, the pump comprises a removable pre-assembled subassembly consisting at least of a bearing surface and a tubing.

The invention also relates to a pre-assembled subassembly consisting of at least a bearing surface and a tubing for a peristaltic pump according to one of the pumps described above.

Preferably, the subassembly also comprises an outer shell component, the outer component having tracks.

The invention also relates to a pre-assembled subassembly consisting of a bearing surface and a tubing for a peristaltic pump as described above.

BRIEF DESCRIPTION OF THE DRAWING FIGURES

The invention will be more clearly understood, and further aims, details, characteristics and advantages thereof will emerge more clearly from the following description of a particular embodiment of the invention, which is given solely by way of non-limiting illustration, with reference to the appended drawings. In these drawings.

DETAILED DESCRIPTION OF THE INVENTION

The currently preferred embodiment of the peristaltic pump according to the invention will now be described with reference to the appended figures.

Figure 1:
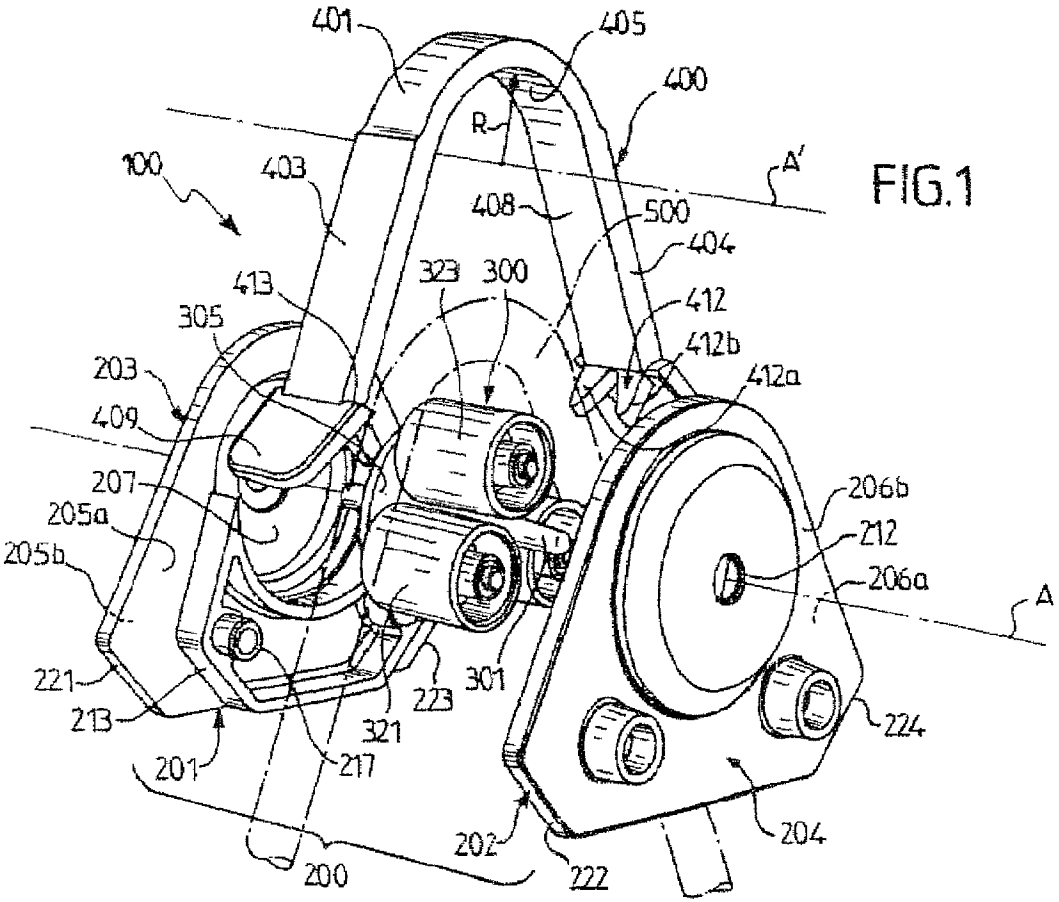
FIG. 1 is an exploded perspective view of the preferred embodiment of the peristaltic pump according to the invention.
Figure 2:
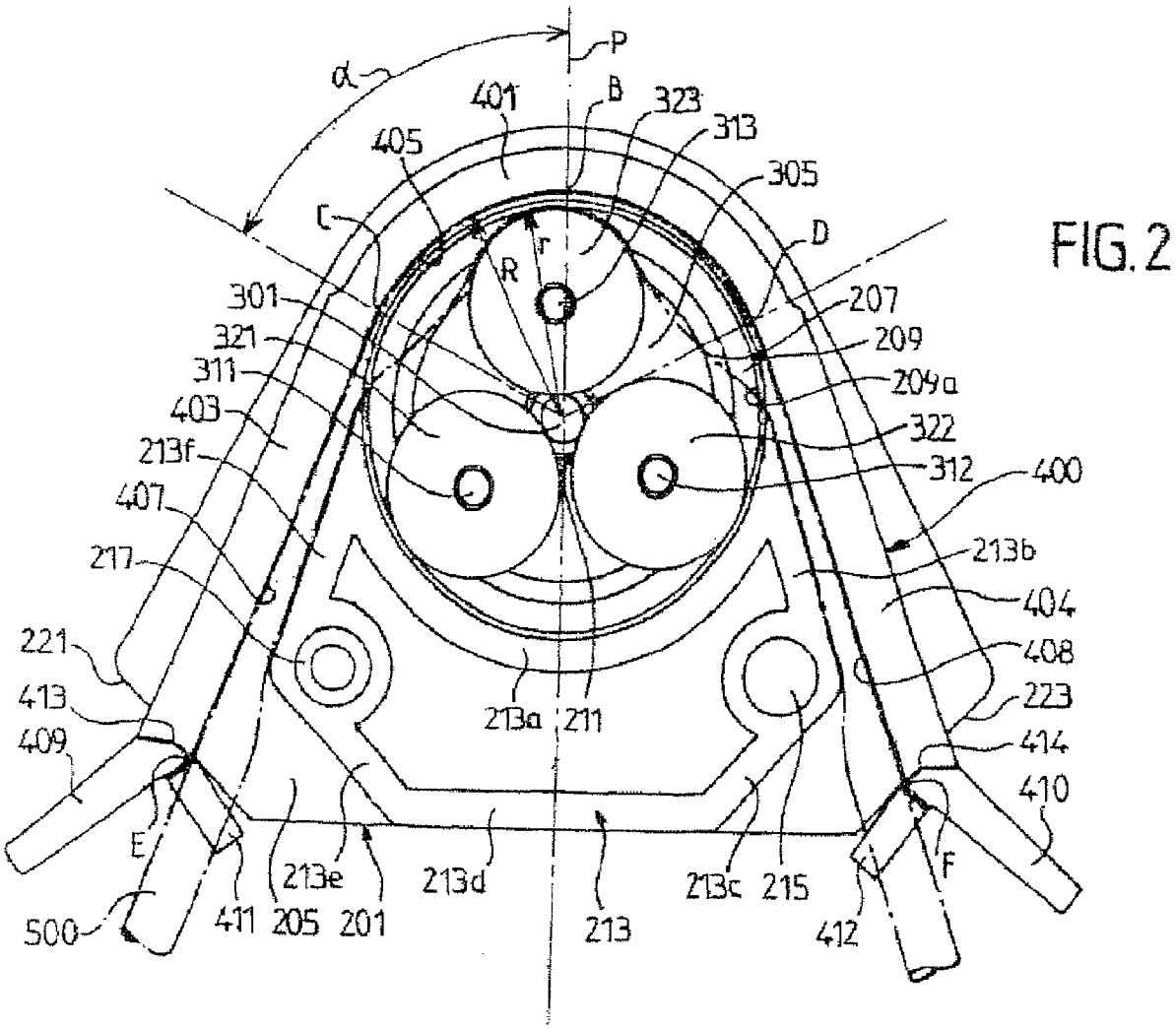
FIG. 2 is a side view of the peristaltic pump of FIG. 1, one of the half-shells being removed for clarity.
Figure 3:
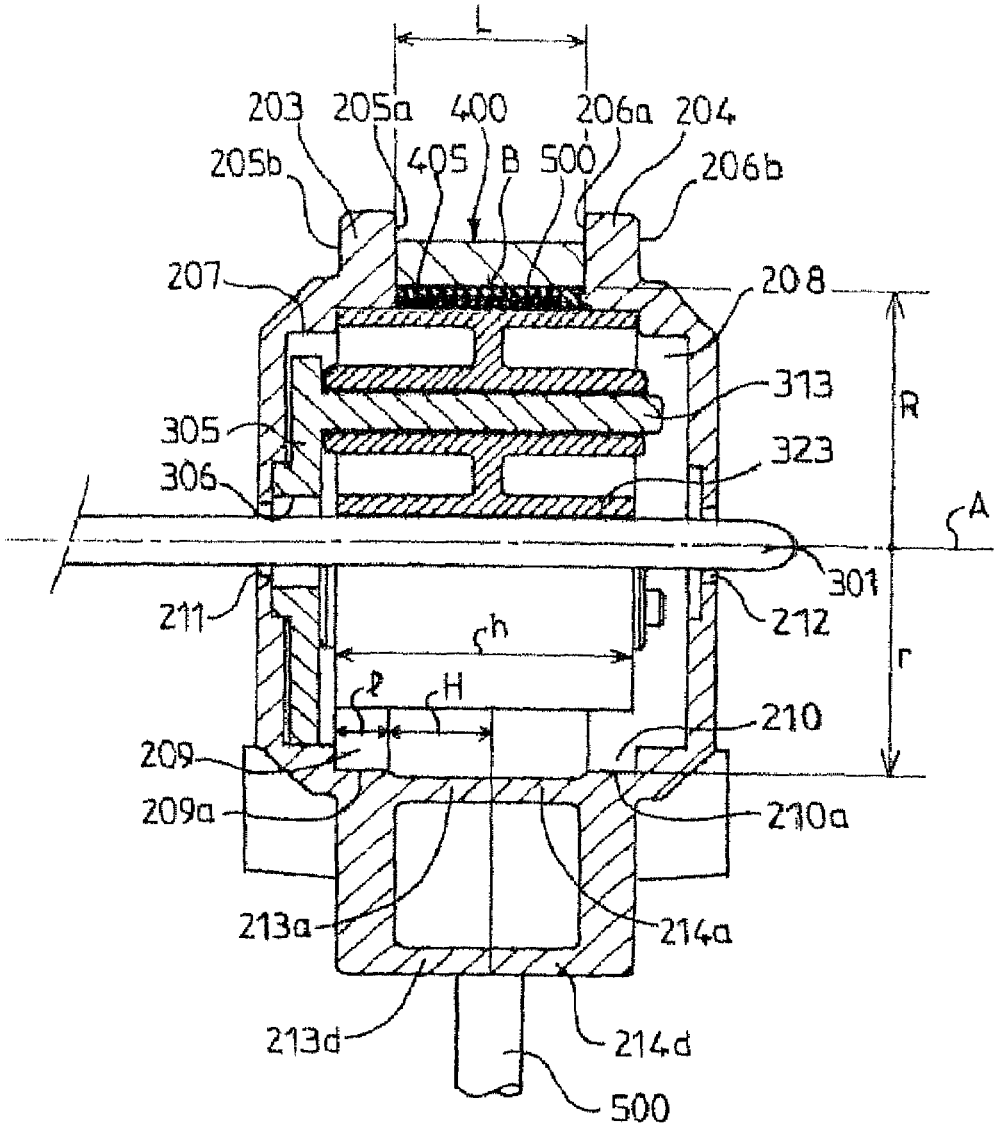
FIG. 3 is a section along the plane III-III, the main plane of symmetry P, of the peristaltic pump of FIG. 2.

With reference to FIGS. 1 to 3, the peristaltic pump 100 comprises a shell 200, a drive device 300, a movable bearing surface 400 and a deformable pump body tubing 500 (shown in chain line in FIG. 2).

The shell 200 is composed of a first half-shell 201 and a second half-shell 202. The first and second half-shells are strictly identical. If they are made of plastic, as in the currently preferred embodiment, each of the two half-shells may be moulded using a single mould.

The first half-shell 201 will now be described in detail. Everything that will be said about the first half-shell 201 applies identically to the second half-shell 202. Consequently, each element of the second half-shell 202 bears the same reference number as the corresponding element of the first half-shell 201, increased by one unit.

The first half-shell 201 comprises a first main wall 203. When the first and second half-shells 201 and 202 are assembled together, the surface of the first main wall 203 facing the second half-shell 202 is called the "first inner surface" 205*a*. The surface of the first main wall 203 opposite the first inner surface 205*a* is called the "first outer surface" 205*b*.

The first main wall 203 has the overall shape of an isosceles triangle. In FIG. 2, the base of this triangle is situated "horizontally" and the height from the base is situated "vertically". The qualifiers "horizontal" and "vertical" are arbitrary and do not presuppose a particular orientation of the peristaltic pump but simply give a relative orientation to the elements they describe. The plane perpendicular to the base which contains the height will be called the "main plane of symmetry" and will be denoted P in this document.

On the side of the first inner surface 205*a*, the first main wall 203 has a bore 207 whose axis A, which is horizontal in FIG. 2, lies in the main plane of symmetry P. The bore 207 has a shoulder 209. The end wall of the bore 207 has a hole 211 passing through the first main wall 203 that can accommodate, without friction, a drive shaft 301, as will be described below.

Moreover, the first inner surface 205*a* comprises a strengthening wall 213 projecting perpendicularly to the said main wall 203. The strengthening wall 213 has a height H (FIG. 3). As shown in FIG. 2, the strengthening wall 213 has a complex shape that is symmetrical about the main plane of symmetry P. The strengthening wall 213 comprises a central portion 213*a* in the shape of an arc of a circle of axis A, a first upstream release portion 213*e* and a first upstream counter-bearing surface portion 213*f* on the intake side (left hand side in FIG. 2), a first downstream counter-bearing surface portion 213*b* and a first downstream release portion 213*c* on the delivery side (right hand side in FIG. 2), and lastly a base portion 213*d* connects the first upstream release portion 213*e* and the first downstream release portion 213*c*.

At the junction between the first downstream 213*b* or upstream 213*f* counter-bearing surface portions and first downstream 213*c* or upstream 213*e* release portions, the support wall 213 is provided, on the delivery side, with a female positioning means 215 and, on the intake side, with a male positioning means 217.

Lastly, the main wall 203 is chamfered. The identical angles of the isosceles triangle which is formed by the main wall 203 (the angles made at the base of the said wall) are cut off. In this way, the main wall 203 has at its periphery a first upstream lateral surface 221 and a first downstream lateral surface 223. Note that the first upstream and downstream lateral surfaces 221 and 223 make an overall angle of 135° with the base of the main wall 203.

The second half-shell 202, which is identical to the first half-shell 201, is turned around by 180° and faces the first half-shell 201. Thus the first male positioning means 217 is housed inside the second female positioning means 216 and the first female positioning means 215 houses the second male positioning means 218. Thus the second half-shell 202 is correctly positioned laterally with respect to the first half-shell 201. The two half-shells are brought together until the first strengthening wall 213 comes into contact, over its entire section, with the second strengthening wall 214. In this way, the first and second main walls 205 and 206 are both parallel and held a predetermined distance from one another which is equal to 2H. The two half-shells 201 and 202 are held in this correct assembly position by adhesive bonding, screws or any other known means.

When the two half-shells 201 and 202 are assembled, the first bore 207 and the second bore 208 form the casing for the peristaltic pump 100.

Moreover, the first and second upstream lateral surfaces 221 and 222 form an upstream guide surface or track 251, and the first and second downstream side surfaces 223 and 224 form a downstream guide surface or track 252.

The drive device 300 comprises a separator 305 with a through hole 306 at its centre. The separator 305 has a plurality of rods distributed regularly in an annular arrangement, mounted perpendicularly to the plane of the separator. Each of the rods of the plurality of rods bears a cylindrical roller that can rotate freely. In the currently preferred embodiment, the separator 305 has three rods 311, 312 and 313 and three rollers 321, 322 and 323. Each roller is therefore spaced angularly from its neighbour by 120°.

When the first and second half-shells 201 and 202 are assembled together, the drive means 300 are housed in the casing formed by the facing first and second bores 207 and 208. The separator 305 is accommodated without friction and is therefore free to rotate at the end wall of the first bore 207, beyond the first shoulder 209.

When the two half-shells 201 and 202 are in the assembled position, the height h of a cylindrical roller is such that a first end of the roller is positioned inside the first shoulder 209 and the second end of the roller is positioned inside the second shoulder 210 (FIG. 3). If l corresponds to the depth of the shoulders 209 and 210, the following relationship holds: $2H<h<2H+2l$.

The frame of the peristaltic pump 100 thus formed is mounted on the drive shaft 301 of a motor, for example an electric motor (not shown) that can rotate the said rollers 321, 322 and 323.

The drive shaft 301 passes through the first hole 211 and the hole 306 in the separator 305. The drive shaft 301 is then force-fitted between the plurality of rollers. The latter are then pressed against the first and second axial surfaces 209*a* and 210*a* of the first and second shoulders 209 and 210. Lastly, the drive shaft 301 passes through the second hole 212 in the second wall 204 of the second half-shell 202.

The rotation of the drive shaft is transmitted to the rollers simply by the rolling, without slipping, of the drive shaft 301 on the outer axial surfaces of the rollers 321, 322, 323. The rollers run around the first and second axial surfaces 209*a* and 210*a* of the first and second shoulder 209 and 210. The first and second axial surfaces 209*a* and 210*a* therefore define, respectively, first and second rolling paths of radius r.

The movable bearing surface 400 comprises an intermediate portion 401 and first and second side arms 403 and 404, one on either side of the intermediate portion 401. The movable bearing surface 400 is symmetrical about a plane of symmetry which, when the movable bearing surface is assembled on the frame of the peristaltic pump, corresponds to the main plane of symmetry P.

The intermediate portion 401 has a shape corresponding to a portion of a ring of axis A' and rectangular cross section. The ring portion extends angularly on either side of the main plane of symmetry P over an arc of half-angle $\alpha$ at the peak, the peak or apex corresponding to the point B. The intermediate inner surface 405 of the intermediate portion 401 is the radially inner axial surface of the ring.

In the currently preferred embodiment, the first and second side arms 403 and 404 are straight. As a variant, and to solve problems of ergonomy and of space available in some applications, the side arms may be in other forms: bent, with an angle of rectangular section. The surface of the first side arm 403 that is joined tangentially to the intermediate inner surface 405 of the intermediate portion will be called the first inner surface 407 of the first side arm 403. Likewise, the second side arm 404 has a second inner surface 408 joined tangentially to the intermediate inner surface 405.

Moreover, the first and second side arms 403 and 404 respectively comprise, at their free end, away from the end joined to the intermediate portion 401, grip means, means for holding the tubing, and guide means.

The grip means 409 are formed as one piece with the side arms by bending the end portion of the corresponding side arm outwards from the movable bearing surface 400. The first and second side arms 403 and 404 respectively have a bend at the point E and F.

The tubing holding means consist of a part 411 (412) in the form of an arch, whose central portion is joined to the inner surface 407 (408), in the width thereof, at the point E (F). The tapered legs 411*a* and 411*b* (412*a* and 412*b*) of the arch project away from the first inner surface 407 (408).

In the currently preferred embodiment, the first guide means 413 consist of first edges 413*a* and 413*b*. The grip means 409 are wider than the first side arm 403 so as to form front and rear bearings on either side of the said arm. These front and rear bearings respectively comprise two bosses which form, where they meet, a first front edge 413*a* and a first rear edge 413*b*. Note that the first front edge lies in the extension of the first rear edge.

Likewise, the second side arm 404 has second guide means 414, the latter consisting of second front and rear edges 414*a* and 414*b*.

The movable bearing surface 400 has a degree of flexibility in the intermediate portion 401. By contrast, the first and second side arms 403 and 404 are rigid. In this embodiment, the movable bearing surface is made as a single piece by moulding a plastic. It is therefore necessary for the intermediate portion 401 to be thinner than the first and second side arms 403 and 404. As the intermediate inner surface 405 is joined tangentially to the first and second inner surfaces of the side arms and there is no discontinuity on the inner surface of the movable bearing surface 400, the variation in thickness between the intermediate portion 401 and each of the first and second side arms 403 and 404 is made up for on the outer surface of the movable bearing surface 400 at the end points C and D of the intermediate portion 401.

Figure 6:
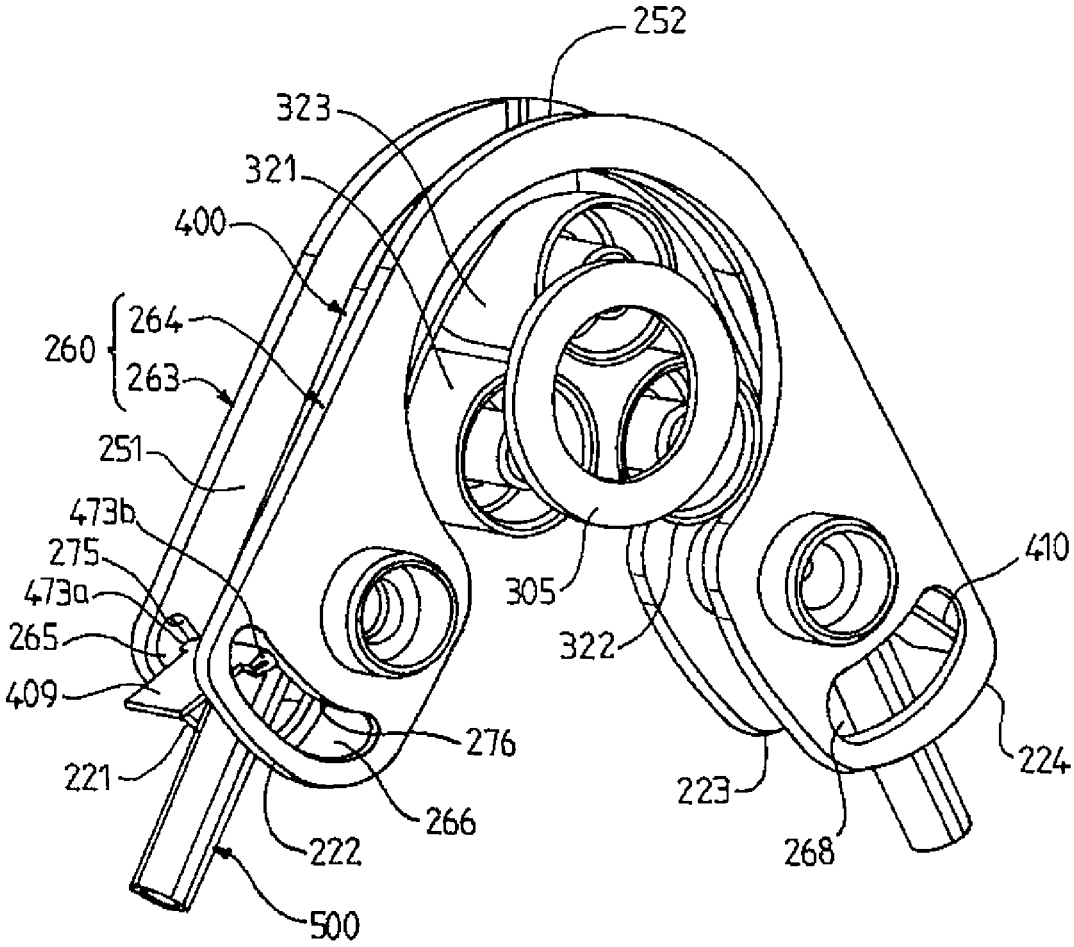
FIG. 6 is a perspective view of another embodiment of the peristaltic pump according to the invention.
Figure 7:
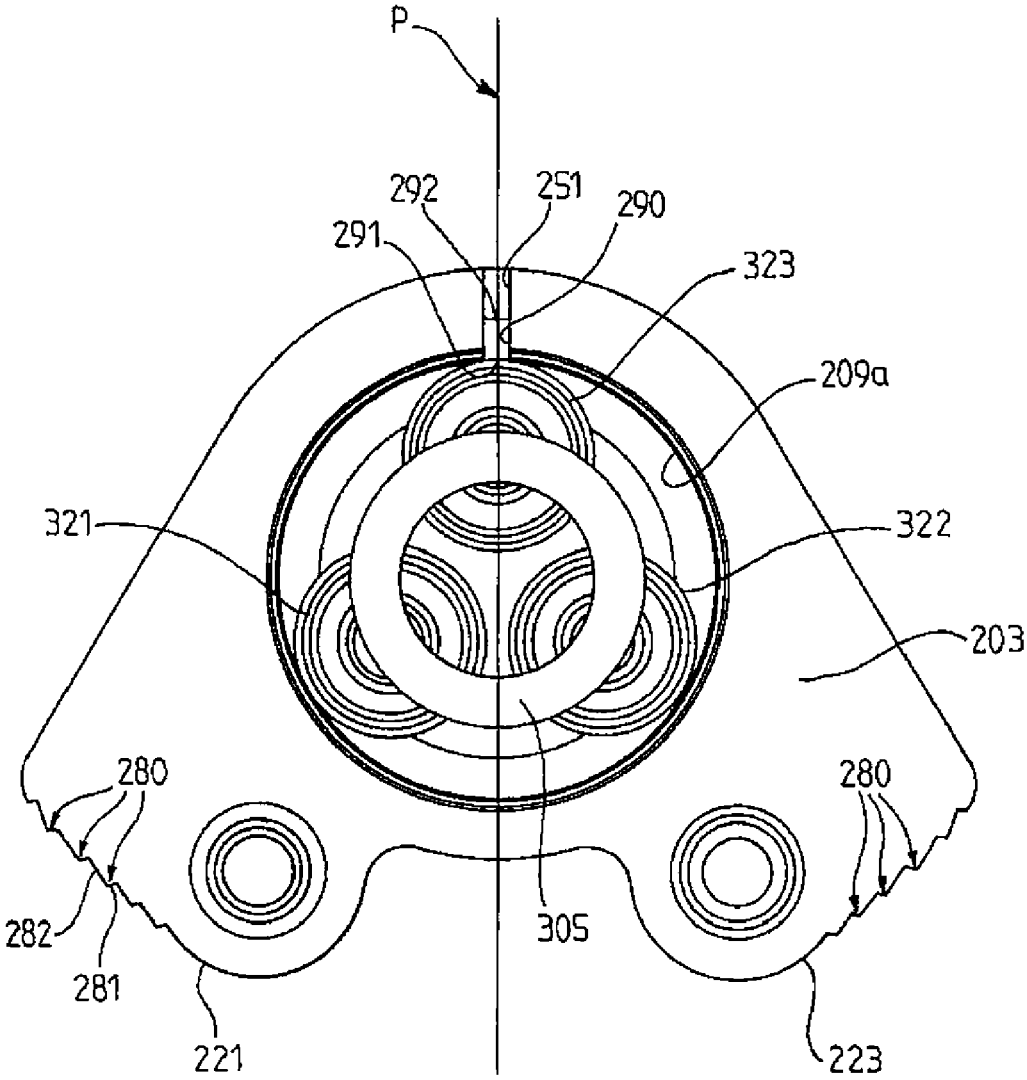
FIG. 7 is a side view of yet another embodiment of the peristaltic pump according to the invention.

In the alternative embodiment shown in FIGS. 6 and 7, the movable bearing surface is made of metal. It is obtained by cutting out a metal plate followed by shaping to produce an elastically deformable strip. This variant enable a movable bearing surface to be obtained which has very precise physical characteristics, such as the Young's modulus which characterizes its elasticity. In this case, the thickness of the movable bearing surface is reduced.

A pump body tubing 500 is positioned against the inner surface of the movable bearing surface 400. More particularly, the tubing is inserted so as to be slightly pinched, upstream between the legs 411*a* and 411*b* of the first arch 411 and downstream between the legs 412*a* and 412*b* of the second arch 412. No longitudinal stress is applied to the tubing if it is correctly positioned along the movable bearing surface. The movable bearing surface 400, with the tubing 500 placed on it, is then clipped in position on the peristaltic pump frame. The user moves the first and second grip means 409 and 410 apart so as to deform the movable bearing surface 400 at its intermediate portion 401 until the guide means 413 and 414 have cleared the widest section of the frame 200 corresponding to the end portions of each of the upstream and downstream tracks 251 and 252. Once they have cleared it the user lets go of the grip means. The movable bearing surface 400 then fits itself correctly on the frame under the effect of forces as will be described later on.

In the correct position of assembly, the axis A' of the intermediate ring-shaped portion 405 coincides with the turning axis A of the rollers. In this way, the inner surface of the movable bearing surface closes the casing formed within the frame of the peristaltic pump. The movable bearing surface 400 is also positioned symmetrically on either side of the main plane of symmetry P. The correct positioning of the movable bearing surface 400 is automatic. The user does not have to make any particular adjustments.

In the assembled position, the intermediate portion 405 is housed between the first and second main walls 203 and 204 of the two half-shells 201 and 202. The width L of the movable bearing surface is therefore slightly less than 2H.

As shown in FIG. 3, the deformable tubing 500 is axially between the two rolling paths 209*a* and 210*a* and radially between the inner surface of the movable bearing surface 400 and at least one of the rollers 321, 322 or 323. As a result, in order for the deformable tubing to be compressed by at least one of the rollers at all times, the angle of opening $2\alpha$ of the intermediate portion 401 must be greater than the angle between two successive rollers. In this case, since the drive device 300 has three rollers, the angle of opening $2\alpha$ must be greater than 120°, this being the case whatever the opening of the movable bearing surface. The worst case being when the bearing surface is very open, i.e. when the guide means 413 and 414 are close to the widest section of the shell 200, i.e. in the top part of the tracks 251 and 252.

The compression of the deformable tubing 500 by at least one of the rollers is expressed as: $R=r+2\delta e$, in which R is the radius of the intermediate inner surface 405 of the intermediate portion 401; r is the radius of the rolling paths 209*a* and 210*a*, which is a geometric constant of the peristaltic pump 100; e is the thickness of the deformable tubing 500; and $\delta$ is a parameter dimensionless less than unity, representing the compression of the two walls of the tubing, one against the other, in order to obtain the nominal sealing dimension.

Moreover, along the first side arm 403, the deformable tubing 500 is slightly compressed between the first inner surface 407 and a facing upstream counter-bearing surface which consists of the first upstream counter-bearing surface portion 213*f* of the first strengthening wall 213 and the second upstream counter-bearing surface portion 214*b* of the second strengthening wall 214. In an identical manner, along the second side arm 404, the deformable tubing 500 is slightly compressed between the second inner surface 408 and a facing downstream counter-bearing surface which consists of the first downstream counter-bearing surface portion 213*b* of the first strengthening wall 213 and the second downstream counter-bearing surface portion 214*f* of the second strengthening wall 214. In this way, during operation of the peristaltic pump 100, the deformable tubing 500 is not entrained by the movement of the rollers.

To physically explain how the peristaltic pump 100 with movable bearing surface 400 works, the particular case of a static position characterized by the fact that the axis of the roller 323 which is compressing the tubing 500 is in the plane of symmetry P will be described in detail. The way the movable bearing surface 400 automatically adapts to various types of tubing and the dynamic operation of the peristaltic pump will be understood from this characteristic position.

Figure 4:
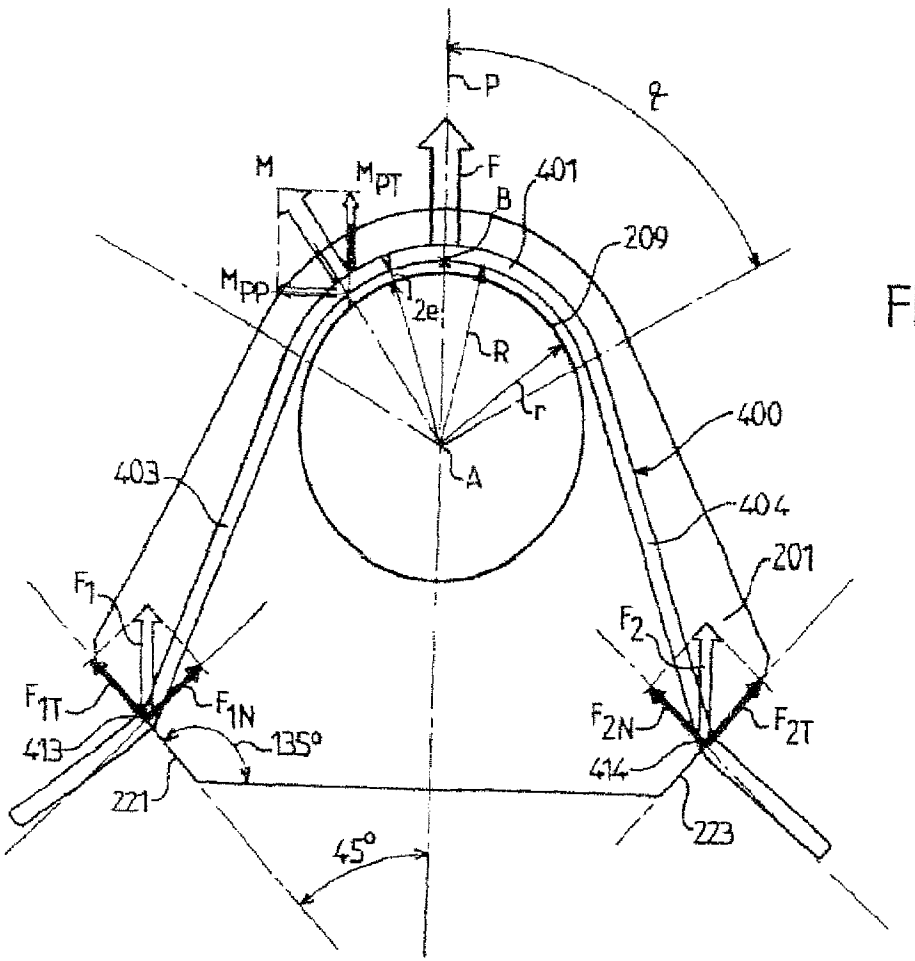
FIG. 4 is a diagram of the forces acting on the movable bearing surface of the peristaltic pump of FIG. 1.

With reference to FIG. 4, a tubing 500 of thickness e is compressed by the roller 323. This roller applies a radial compression force F on the tubing. The compression force F is weak when the tubing 500 is being deformed by moving its walls closer together, then it jumps and increases rapidly once the two walls are brought into contact with one another.

For example, if the tubing 500 is already at its sealing dimension but is too close to the axis of rotation A, the roller will apply an excessive compression force F. We will show below how the movable bearing surface 400 moves so as to move the tubing 500 away from the axis of rotation A.

The compressed tubing 500 transmits the compression force F to the movable bearing surface 400 at the point of contact, in this case the apex B. Moreover, the movable bearing surface 400 is held at the free ends of the side arms by the first and second edges 413 and 414 in contact with the upstream and downstream tracks 251 and 252. Consequently, the force of the tubing on the movable bearing surface is transmitted by the bearing surface as far as the point of contact of the bearing surface with the shell. A force $F_1$ corresponding to half the force F is applied by the first edge to the upstream track 251, and a force $F_2$ corresponding to half the force F is applied by the second edge to the downstream track 252.

The force $F_1$ is made up of a force $F_{1N}$ that is perpendicular and a force $F_{1T}$ that is tangential to the upstream track 251.

Assuming that the coefficient of friction, the reaction of the upstream track on the first edge is perpendicular to the upstream track, the reaction of the upstream track only compensates for the force $F_{1N}$. Likewise, the reaction of the downstream track on the second edge only compensates for the perpendicular component $F_{2N}$. As a result, the first and second free ends of the first and second side arms are respectively subjected to resultant forces corresponding to the components $F_{1T}$ and $F_{2T}$ of the forces $F_1$ and $F_2$.

The components $F_{1T}$ and $F_{2T}$ have a contribution in the plane of symmetry P tending to displace the movable bearing surface 400 upwards. The components $F_{1T}$ and $F_{2T}$ also have contributions perpendicular to the plane of symmetry P and in opposite directions, tending to separate the first and second free ends of the first and second side arms.

The shape of the movable bearing surface 400 is designed such that this separation of the first and second free ends only deforms the intermediate portion 401 of the movable bearing surface 400. This deformation, combined with the upward movement of the movable bearing surface 400, is reflected in a increase $\Delta R$ in the value of the radius R of the intermediate inner surface 405 without any modification of the position of the centre of curvature of the intermediate inner surface 405, the axis A' of the intermediate inner surface 405 coinciding permanently with the axis of rotation A of the rollers. Thus there is an automatic increase in the radius of the bearing surface against which the tubing 500 is compressed. This movement of the bearing surface causes the tubing to take up a position a little further away from the rollers corresponding to its nominal sealing dimension.

The bearing surface 400 acts as a leaf spring. The more the intermediate portion is deformed, the greater the reaction force applied by the bearing surface on the tubing. This reaction force eventually counterbalances the compression force F of the rollers on the tubing. An equilibrium is gradually created so that the tubing arrives at its nominal sealing dimension. In this position of equilibrium the tangential components $F_{1T}$ and $F_{2T}$ cancel one another out.

According to this mechanism, sealing of the tubing 500 is ensured no matter how thick, hard, etc. the tubing is. Sealing is ensured all along the angular opening $2\alpha$ of the intermediate inner surface of the intermediate portion of the movable bearing surface.

Figure 5:
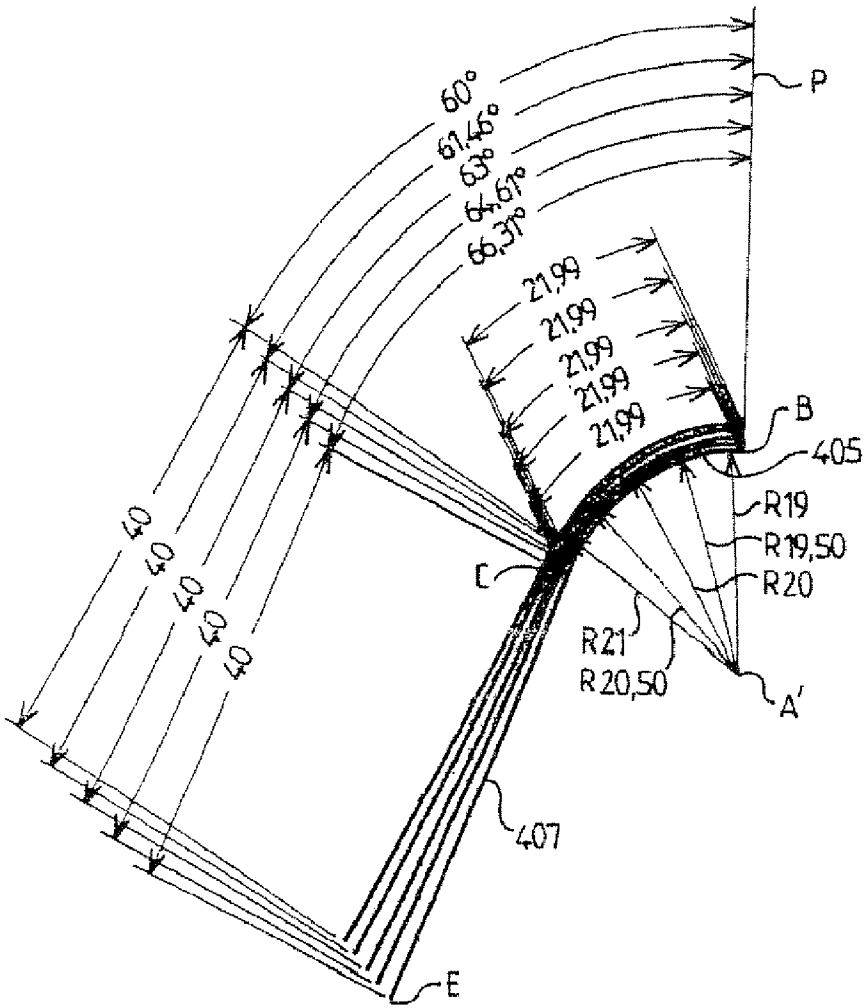
FIG. 5 is a series of curves showing various profiles of the movable bearing surface of the peristaltic pump of FIG. 1.

Based on this principle of operation, the applicant has carried out computer simulations that have enabled it to define a particular profile for a movable bearing surface for a peristaltic pump for medical use. The components of the pump are made of polyurethane. The pump has a radius r of approximately 18 mm. The radius at rest R of the bearing surface is 19 mm. The rigid side arms have a length L of 40 mm corresponding to 2R. The deformations of the profile of the movable bearing surface are shown in FIG. 5. The variation in radius $\Delta R$ is equal to about 10% of the value of the radius R, giving a maximum radius of 21 mm. As the intermediate portion is deformed, the angle of opening of this portion goes from 66° to 60° approximately. The thickness of the movable bearing surface at the intermediate portion is 3 mm, whereas the thickness of the movable bearing surface at the first and second side arms is 5 mm.

In particular, the computer simulations make it possible to define the shape of the guide tracks 251 and 252 that will allow the free ends of the first and second side arms to be held.

In FIG. 5, it can be seen that the upstream and downstream guide tracks are, to a first approximation, line segments inclined at 45° to the vertical axis. Advantage is taken of this simple design to make the guide tracks in the main walls of the shell since the range of geometric tolerances generally allowed when making injection-moulded plastic elements, i.e. ±0.1 mm, is not exceeded. The above description of the half-shells involved an angle of 135° to the base of the isosceles triangle. In the alternative embodiment shown in FIGS. 6 and 7, more precise tracks are described by arcs of a circle, the centre of which is in the main plane P.

Incidentally, the length of the first and second side arms is ctubingn such that the free ends have ample scope for movement making it possible to vary the radius of the intermediate portion of the movable bearing surface in small degrees and such that a small amount of force applied at the free ends of the side arms is converted into a considerable reaction force applied by the bearing surface on the tubing, the side arms acting as lever arms.

Note that there is a difference in behaviour compared with what has been described above. In FIG. 4, when the roller compressing the tubing is outside of the plane of symmetry P, the force applied by the tubing to the movable bearing surface is a radial force M having a component $M_{PT}$ in the main plane of symmetry P having the effects described above, but also a component $M_{PP}$ perpendicular to the said plane of symmetry P having the effect of pushing the movable bearing surface 400 out of the main plane of symmetry. This is why the apex B of the intermediate portion may have an additional hook included in the thickness of the movable bearing surface 400. This additional metal hook has an axis parallel to the axis A. The additional hook projects on either side of the movable bearing surface 400 and engages in first and second grooves 251 and 252 (FIG. 7) made respectively in the first and second main walls 203 and 204 on the side of the inner surfaces 205*a* and 206*a* of the said walls. The first and second grooves lie in the main plane of symmetry P. The movable bearing surface 400 is therefore prevented from moving out of the main plane of symmetry P, the perpendicular component $M_{PP}$ being compensated for by the reaction of the additional hook against the side edges of each of the first and second grooves 251 and 252.

It also appears that the fact that the movable bearing surface 400 moves slightly out of the main plane of symmetry P has a smoothing effect on the pressure fluctuations constituting a known conventional phenomenon of peristaltic pumps.

Since the peristaltic pump described above is used for medical applications, among others, it is convenient for a pre-assembly composed of a bearing surface and tubing to be offered as a single-use disposable consumable. The tubing is for example already pinched between the first and second fastening means and positioned against the inner surface of the movable bearing surface. Optionally, the elastomer tubing is adhesively bonded at various points along the inner surface of the movable bearing surface. The pre-assembly thus formed is then packaged in a sterile bag. The characteristics of the tubing and the type of frame onto which the movable bearing surface can be clipped are stated on the bag. The user simply has to unwrap the pre-assembly and clip it onto the corresponding frame.

The immediate advantage is that it allows not only both the electric motor and the drive shaft 301 to be reused from one application to the next, as in the prior art, but also the frame assembly consisting of the shell 200 and the drive device 300. The consumable, having a smaller number of parts, is less expensive. It is easy to position, self-adjusts automatically and makes it possible to avoid adjustment errors.

Thus the peristaltic pump according to the invention may be used with various types of tubing. The variation in the thickness of the walls of the tubing, which has various causes (manufacture, wear, different types of tubing, etc.), is compensated for automatically by the adjustment of the radius of the intermediate inner surface of the movable bearing surface.

FIG. 6 shows another embodiment of the invention. In this embodiment, the shell consists of two components: an inner component (not shown) forming a casing for housing the rollers, and an outer component 260 bearing the guide tracks. Once assembled, the inner and outer 260 components form a shell similar to the shell 200 described in the currently preferred embodiment illustrated in FIGS. 1 to 5.

Two subassemblies can thus be distinguished: first, a fixed subassembly optionally comprising the motor, the separator 305, the rollers 321, 322 and 323 and the inner component of the shell; and, second, an interchangeable subassembly comprising a tubing 500, a movable bearing surface 400 and the outer component 260 of the shell (and hence the guide tracks). The interchangeable subassembly may for example be connected to a bottle containing liquid to be pumped. The user combines the fixed and interchangeable subassemblies to form a peristaltic pump with its volume of liquid to be pumped.

Moreover, in FIG. 6, the movable bearing surface 400 consists of a metal strip comprising an intermediate portion in the shape of an arc of a circle and straight and rigid upstream and downstream side arms on either side of the intermediate portion. The bearing surface 400 has a small thickness. In particular, the guide means are upstream 473*a* and 473*b* and downstream 474*a* and 474*b* bosses consisting of tongues cut out of the mass of the metal strip when it is being cut. The tongues are then bent back on themselves to form a boss which can slide along the guide tracks.

According to a variant embodiment of the peristaltic pump, the upstream and downstream guide tracks 251 and 252 are not located on the upstream 221 and 222 and downstream 223 and 224 lateral surfaces of the shell, but on the lateral surfaces of recesses made in the main walls of the shell. More particularly, the first main wall 263 of the outer component 260 comprises a first upstream recess 265 and a first downstream recess 266. Likewise, the second main wall 264 of the outer component 260 comprises a second upstream recess 266 and a second downstream recess 268. The lateral surfaces 275 and 276 closest to the axis of rotation A of the recesses 265 and 266, respectively, have a predefined path for forming the upstream track 251. Likewise, the lateral surfaces 277 and 278 closest to the axis of rotation A of the recesses 267 and 268, respectively, have a predefined path for forming the downstream track 252. Thus, and advantageously for the embodiment of FIG. 7 in which the shell is the combination of two subassemblies, the movable bearing surface 400 is associated with the outer part 260 of the shell in such a way as to join together the constituent components of the interchangeable subassembly. The movable bearing surface is housed in the outer part 260, i.e. the bosses 473*a, b* and 474*a, b* are housed in the corresponding recesses 265-278 when the main walls 264 and 263 of the outer part 260 are superposed.

Note that the guide tracks are in the form of arcs of a circle, the centre of which is in the main plane P. This particular path of the tracks results from the particular geometric characteristics of this embodiment of the peristaltic pump (length of the lever arms of the side arms, range of tubes usable in this pump, etc.), the greater precision achieved in production of the tracks by moulding, and the use of a metal movable bearing surface manufactured with great precision.

FIG. 7 shows yet another embodiment of the invention. In this embodiment, the first and second upstream and downstream lateral surfaces are no longer smooth surfaces, but comprise a plurality of millimetric notches 280. The shape of each notch 280 is asymmetrical. A notch consists of a short surface 281, oriented in the direction of the main plane of symmetry P, making a large angle with the tangent of the path of the track 251 or 252, and a long surface 282, oriented away from the main plane of symmetry P, making a small angle with the tangent to the path of the track 251 or 252.

Thus, the bosses 473*a, b* and 474*a, b* of the movable bearing surface 400 can move along the track 251 and the track 252 only in the direction of clamping of the tubing 500, i.e. towards the main plane of symmetry P. This direction is preferred since it corresponds to the normal evolution of a tubing during use, under the effect of wear and the loss of elasticity of the tubing wall. Moreover, this arrangement allows the peristaltic pump to withstand high operating pressures without modification of the radius of curvature, the bosses bearing on the short surfaces 281 of the notches 280.

In FIG. 7, the groove 251 for guiding the hook located at the apex of the movable bearing surface 400 is shown. It comprises a wedge 290. The wedge 290 makes it possible, when the peristaltic pump is in the storage position, to keep the movable bearing surface 400 away from the rollers 321-323 so that the pump body tubing 500 is not compressed or stressed during this period of storage.

To this end, the wedge 290 is of generally parallelepiped shape and can be inserted in the groove 251. The surface 291 of the wedge 290 which bears on the roller 323 located in the main plane P is circular. It has a radius of curvature equal to that of the outer surface of the roller 323. The hook located at the apex of the movable bearing surface bears on a surface 292 of the wedge 290 opposite the cylindrical surface 291.

When the user wishes to use the peristaltic pump, the drive motor strains so as to apply an additional torque so that the roller 323 is released from the wedge 290 and can roll along the rolling path 209. The wedge 290 is then pushed upwards and lifts the movable bearing surface 400. Next, once the roller 323 has been released from the wedge 290, the latter falls down behind the roller 323 into the gap between two successive rollers. The movable bearing surface 400, which is then no longer supported by the wedge 290, slides along the groove 251 and places itself automatically in its correct operating position.

Although the invention has been described in relation to a particular embodiment, it is of course not at all limited to this embodiment and comprises all technical equivalents of the means described and all combinations thereof so long as these fall within the scope of the invention.

The invention claimed is:

1. A peristaltic pump (100), designed to operate with a deformable flexible pump body tubing (500), comprising:

a shell (200);

a bearing surface (400) forming a casing with said shell; and a plurality of cylindrical rollers (321, 322, 323) housed inside said casing, said rollers being rotatable about a main axis (A) and able to compress said tubing at least one point on a surface of said bearing surface facing the inside of said casing, called an inner surface, wherein said bearing surface (400) comprises an intermediate deformable portion (401) with an intermediate inner surface (405) having the shape of a cylinder whose axis (A') coincides with said main axis, and first and second rigid side arms (403, 404) on either side of said deformable intermediate portion, first and second free ends (E, F) of said first and second rigid side arms comprising, respectively, first and second guide means (413, 414), and in that said shell comprises upstream and downstream tracks (251, 252) on which said first and second guide means can slide in an assembled position of said pump, said upstream and downstream tracks comprising chamfered lateral surfaces of first and second main walls of said shell and respective predefined paths for limiting the displacement of said first and second free ends of the first and second rigid side arms so as to deform said deformable intermediate portion so that a radius of said intermediate inner surface is modified while leaving said axis of said intermediate inner surface in coincidence with said main axis, so that said peristaltic pump adapts automatically to a tubing having variable physical and geometric properties.

2. The peristaltic pump according to claim 1, wherein said bearing surface (400) is removable to allow a pump body tubing (500) to be positioned between at least one roller of said plurality of rollers (321, 322, 323) and said intermediate inner surface (405) of said deformable intermediate section (401) of the bearing surface.

3. The peristaltic pump according to claim 2, wherein said bearing surface (400) is placed on said shell (200) of said peristaltic pump (100) during starting up of said peristaltic pump.

4. The peristaltic pump according to claim 3, wherein said bearing surface is placed on said shell by snapping the first and second guide means (413, 414) onto said upstream and downstream tracks.

5. The peristaltic pump according to claim 2, wherein said shell comprises a combination of an inner component and an outer component (260), said bearing surface being joined to said outer component so as to optionally form an interchangeable subassembly with a pump body tubing, the interchangeable subassembly being placed on said inner component of the shell during starting up of said peristaltic pump.

6. The peristaltic pump according to claim 1, wherein said peristaltic pump (100) is symmetrical about a main plane of symmetry (P) defined by said main axis (A) and a bisector of an angle of opening of said intermediate inner surface (405).

7. The peristaltic pump according to claim 1, wherein a variation in the radius ($\Delta R$) of said intermediate inner surface (405) with respect to a radius at rest (R) of the radius of said intermediate inner surface is no more than 10%.

8. The peristaltic pump according to claim 1, characterized in that said plurality of rollers (321, 322, 323) comprises three rollers and said intermediate inner surface (405) has an angle of opening of at least 1200 so that, at any time, at least one of said three rollers is opposite said intermediate inner surface, said tubing (500) being compressed at at least one point.

9. The peristaltic pump according to claim 1, wherein a length of said first and second side arms (403, 404) is between 0.9 and 1.2 times the value of a radius at rest (R) of said intermediate inner surface (405).

10. The peristaltic pump according to claim 1, wherein said predefined path of said upstream and downstream tracks is comparable to first and second line segments lying in a plane perpendicular to said main axis (A), said segments each making an angle of about 45° with a main plane.

11. The peristaltic pump according to claim 1, wherein said predefined path of said upstream and downstream tracks is comparable to arcs of a circle, the centre of which lies in a plane perpendicular to said main axis (A).

12. The peristaltic pump according to claim 1, wherein said first and second guide means comprise first and second bosses (413, 414) situated laterally on the respective free ends of each of said first and second side arms (403, 404), and able to slide respectively along said upstream and downstream tracks.

13. A peristaltic pump (100), designed to operate with a deformable flexible pump body tubing (500), comprising:

a shell (200);

a bearing surface (400) forming a casing with said shell; and a plurality of cylindrical rollers (321, 322, 323) housed inside said casing, said rollers being rotatable about a main axis (A) and able to compress said tubing at least one point on a surface of said bearing surface facing the inside of said casing, called an inner surface, wherein said bearing surface (400) comprises an intermediate deformable portion (401) with an intermediate inner surface (405) having the shape of a cylinder whose axis (A') coincides with said main axis, and first and second rigid side arms (403, 404) on either side of said deformable intermediate portion, first and second free ends (E, F) of said first and second rigid side arms comprising, respectively, first and second guide means (413, 414), and in that said shell comprises upstream and downstream tracks (251, 252) on which said first and second guide means can slide in an assembled position of said pump, said upstream and downstream tracks having respective predefined paths for limiting the displacement of said first and second free ends of the first and second rigid side arms so as to deform said deformable intermediate portion so that a radius of said intermediate inner surface is modified while leaving said axis of said intermediate inner surface in coincidence with said main axis, so that said peristaltic pump adapts automatically to a tubing having variable physical and geometric properties, and wherein said upstream and downstream tracks consist of lateral surfaces of recesses made in the first and second main walls of said shell.

14. The peristaltic pump according to claim 1, wherein the upstream and downstream tracks are notched.

15. The peristaltic pump according to claim 1, wherein said bearing surface (400) comprises secondary guide means mechanisms located at the apex (B) of said deformable intermediate portion (405) and projecting laterally on either side of the latter, and in that said shell (200) comprises first and second grooves (251, 252) made, in said main plane of symmetry (P), in first and second main walls (203, 204) of said shell, said grooves being designed to cooperate with said secondary guide mechanisms to keep the bearing surface symmetrical about said main plane of symmetry during operation of said peristaltic pump.

16. The peristaltic pump according to claim 1, wherein the peristaltic pump further comprises storage means which enable said bearing surface to be held in place on said shell so that said pump body tubing is not stressed during storage of said pump, said storage means allowing the bearing surface to be correctly positioned during use of said pump.

17. The peristaltic pump according to claim 1, wherein said shell (200) comprises upstream and downstream fixed counter-bearing surfaces that are placed respectively facing first and second inner surfaces (407, 408) of said first and second side arms (403, 404) to keep the tubing (500) stationary with respect to said bearing surface (400) during use of said peristaltic pump.

18. The peristaltic pump according to claim 1, wherein the peristaltic pump further comprises a removable pre-assembled subassembly consisting at least of a bearing surface (400) and a tubing (500).

* * * * *